US007540905B2

(12) United States Patent
Blangetti et al.

(10) Patent No.: US 7,540,905 B2
(45) Date of Patent: Jun. 2, 2009

(54) DEAERATING AND DEGASSING SYSTEM FOR POWER PLANT CONDENSERS

(75) Inventors: Francisco Leonardo Blangetti, Baden (CH); Hartwig E. Wolf, Ennetbaden (CH)

(73) Assignee: Alstom Technology Ltd, Baden (CH)

( * ) Notice: Subject to any disclaimer, the term of this patent is extended or adjusted under 35 U.S.C. 154(b) by 849 days.

(21) Appl. No.: 11/092,342

(22) Filed: Mar. 29, 2005

(65) Prior Publication Data

US 2006/0010869 A1 Jan. 19, 2006

Related U.S. Application Data

(63) Continuation of application No. PCT/EP03/50658, filed on Sep. 25, 2003.

(30) Foreign Application Priority Data

Sep. 30, 2002 (DE) ..... 102 45 935

(51) Int. Cl.
*B01D 19/00* (2006.01)

(52) U.S. Cl. ..... 96/181; 96/194; 95/185; 95/260; 95/244

(58) Field of Classification Search ..... 95/185, 95/260, 244; 96/181, 194, 204; 60/646, 60/656, 657, 692; 261/98
See application file for complete search history.

(56) References Cited

U.S. PATENT DOCUMENTS 1,353,855 A * 9/1920 Scanes ..... 165/113
1,542,544 A * 6/1925 Elliot ..... 60/646
2,626,005 A * 1/1953 Sebald ..... 95/244
5,343,705 A * 9/1994 Athey et al. ..... 60/646
6,145,315 A * 11/2000 Blangetti et al. ..... 60/646
6,318,087 B1 * 11/2001 Baumann et al. ..... 60/657

FOREIGN PATENT DOCUMENTS

DE 29 38 631 C2 6/1980
DE 195 06 757 A1 8/1996
DE 199 24 853 A1 12/2000
FR 1085112 * 1/1955
FR 1 085 112 A 1/1985

OTHER PUBLICATIONS

International Search Report PCT/EP03/50658.
German Search Report and partial translation of DE 102 45 935.5.

* cited by examiner

*Primary Examiner*—Duane Smith
*Assistant Examiner*—Douglas J Theisen
(74) *Attorney, Agent, or Firm*—Darby & Darby

(57) ABSTRACT

A deaerating and degassing system for a power plant condenser, comprising a condensate collector and optionally an air cooler, whereby the deaerating and degassing system includes a suction aggregate and a suction line for a steam-inert gas mixture and the suction line connects the condenser or, in case an air cooler is present, the air cooler of the condenser, to the suction aggregate. In the suction line, there is a direct-contact condensation device, for example, a packing column or a tray contact apparatus, through which the steam-inert gas mixture can flow in direct contact in a countercurrent to the chilled condensate from the condensate collector.

15 Claims, 2 Drawing Sheets

DEAERATING AND DEGASSING SYSTEM FOR POWER PLANT CONDENSERS

The present invention relates to the field of power plant technology. It pertains to a deaerating and degassing system for power plant condensers.

BACKGROUND

Power plant condensers are devices that bring about a reduction in the counterpressure by condensing the exhaust steam of steam turbines. Their task is to dissipate to the outside the thermal energy of the steam that has not been converted into electricity.

Familiar devices are, for instance, surface condensers, which consist of a housing with a built-in network of pipes. During operation of the power plant, turbine steam flows through an inlet, through the condenser neck, and into the condensation chamber, where it is condensed on the outside of the condensate pipes, through which a coolant, usually cooling water, flows. The condensate that is formed is then collected in a condensate collector, the so-called hot well, in the lower part of the condenser and subsequently returned to the steam circulation system by means of condensate pumps. In this process, it passes through the preheater and the feedwater line, reaching the boiler, where it is evaporated once again and drives the turbines as working steam.

Via the turbine counterpressure, the capacity of the condenser decisively influences the efficiency of the entire installation and thus the power of the generator.

Since the condenser pressure is below atmospheric pressure, some leakage air is continuously penetrating the condenser. This air as well as other non-condensable fractions such as, for example, endogenous non-condensable radiolysis gases (non-condensable mixture of $H_2$ and $O_2$ from the stoichiometric breakdown of water) have to be removed from the condensers.

For this purpose, deaerating or degassing suction apparatuses are used that are connected to the condensers in such a way that, at a place with the lowest possible vapor pressure and with the highest possible gas concentration, they suction off a gas-steam mixture from the condensation chamber of the condensers.

The reason for this measure is the worsening of the condensation capacity and thus of the condensation pressure in power plants caused by the reduction in the heat-transfer coefficient due to the presence of even small concentrations of non-condensable components, which are also referred to as inert gases.

This worsening is already noticeable at a fraction of a percentage in the mole fraction and, from about 1% onwards (mole fraction of air=0.01), it causes a drastic worsening of the heat transfer. In order to minimize this effect, so-called air coolers are installed in the condensation chamber.

Air coolers are funnel-shaped sheet metal structures in the piping system. They cause a spatial acceleration of the steam-inert gas mixture, so that the steam speed at the pipe web does not drop too low due to the self-suctioning effect of the condensation and of the suction system, thus remaining within the range of 2 to 3 m/s. This partially reduces the negative effect of the non-condensable gases. At the end of the funnel-shaped air cooler, the gas-steam mixture, which has an inert-gas fraction ranging from a few percent to about 20% in the mole fraction (mole fraction of air=0.2), is then discharged to the outside by means of the suction aggregates, for instance, vacuum pumps. Furthermore, the concentration of the inert gases in the mixture causes a significant reduction in the mass-volume flow of the mixture to be suctioned off.

Therefore, the air cooler arranged inside the condenser has the function of attaining the greatest possible concentration of the inert gases (non-condensable gases) in the mixture since this is to bring about the following advantages:

- improvement of the capacity of the vacuum pumps (low suction pressure);
- reduction in the requisite vacuum pump capacity;
- reduction in the loss of circulation material (pure water).

If the concentration of the non-condensable components is too low, the suction apparatus is additionally thermally stressed due to the enthalpy load caused by the excess steam, as a result of which cavitation problems occur when liquid-seal pumps and water-jet aspirators are employed, whereas steam-jet ejectors are less susceptible to this phenomenon.

The loss of condensation capacity due to the presence of inert gases is drastic. For instance, the condensation capacity typically amounts to 20 to 30 $kW/m^2$ in the main condensation pipe system and it can drop to 0.3 to 0.5 $kW/m^2$ in the preheater and air-cooler chamber. This corresponds to a reduction of the rates of heat flow per unit of area by one and a half orders of magnitude.

The drawback of this known state of the art is that there is often insufficient suction capacity in the power plants, especially when the condensers of boiling water reactors undergo retrofitting along with a concurrent increase in output. In such cases, the available suction capacity is usually no longer sufficient for the newly established pressure and for the current thermal output.

But the occurrence of problems due to insufficient suction capacity is also encountered in conventional and nuclear plants with pressurized water reactors. The reason for this lies, for example, in inadequate bundled designs, perforations and leaks in the lines as well as in an improvement of the vacuum due to retrofits since the existing suction apparatuses are not dimensioned for this.

Another disadvantage of the known state of the art is, for instance, the pressure loss via the suction line.

SUMMARY OF THE INVENTION

An object of the present invention is to avoid the disadvantages of the state of the art. The present invention provides a deaerating and degassing system for power plant condensers with which a sufficient suction capacity can be achieved with the original suction aggregate, that is to say, without replacing or retrofitting it after the condensers have been retrofitted, even in the case of a new pressure level and increased thermal output. Moreover, the pressure loss via the suction line is to be reduced and cavitation problems are to be avoided, especially in suction aggregates with liquid-seal pumps and water-jet vacuum pumps.

According to the present invention, in a deaerating and degassing system for power plant condensers that have a condensate collector and optionally an air cooler—whereby the deaerating and degassing system consists essentially of a suction aggregate and a suction line for a steam-inert gas mixture and said suction line connects the condenser (and if an air cooler is present, the air cooler of the condenser), to the suction aggregate—said suction line has a device for direct-contact condensation through which the steam-inert gas mixture can flow in direct contact in a countercurrent to the chilled condensate from the condensate collector.

The advantages of the invention lie in that the system according to the invention makes it possible to achieve a concentration of the non-condensable components while concurrently reducing the mass-volume flow of the suction apparatus mixture. As a result, a sufficient suction apparatus capacity can be attained with the original suction aggregate, that is to say, without replacing or retrofitting it after the condensers have been retrofitted, even in the case of a new pressure level and increased thermal output. Moreover, pressure loss via the suction line is reduced since the volume flow is diminished. Cavitation problems, particularly with suction aggregates that have liquid-seal pumps and water-jet vacuum pumps, are avoided since the gas mixture is far from the cavitation limit. Other advantages are that the direct-contact condensation does away with wall resistance and fouling, phenomena that impair the heat-transfer coefficients. As a result of the continuous destruction and new formation of material and temperature boundary layers in the device used for direct-contact condensation (start-up conditions), good transportation performance can be achieved in both phases through the deflection of the flow.

It is advantageous for the device for direct-contact condensation to consist of at least one packing column. Other advantageous alternatives are stage and tray contact apparatuses or spraying devices.

It is practical for the device for direct-contact condensation to be installed outside of the condenser. If sufficient space is available, the device can also be arranged inside the condenser.

Likewise, it is advantageous for a first condensate line with a built-in condensate pump to branch off from the condensate collector, for a second condensate line to branch off from the first condensate line downstream from the condensate pump, said second condensate line being connected to a tubular or plate heat exchanger in which the condensate is cooled down to a temperature close to the cooling-water inlet temperature, and for a third condensate line for the chilled condensate to lead from the tubular or plate heat exchanger to the device used for direct-contact condensation. Liquid distribution devices such as, for instance, a spraying device, can be arranged in this device. If the condensate is fed in such a manner, that is to say, branched off downstream from the condensate pump and led to the condenser by means of the recirculation line, it is advantageously ensured that a minimum quantity is present, even during start-up or during partial-load operation. Moreover, the requisite amount of condensate is very small. The cooling of the condensate from the condensation temperature to approximately the cooling-water inlet temperature can be achieved particularly well in tubular or plate heat exchangers.

It is likewise advantageous for the device used for direct-contact condensation to have a siphon for the condensate mixture consisting of the returned cold condensate and of the condensate that has newly formed in the device, and for the siphon to open up into the condenser in such a way that the condensate mixture is vented as a wall wet column.

Finally, it is advantageous that, by changing the cold condensate stream and/or its temperature, the composition of the mixture can be precisely controlled.

BRIEF DESCRIPTION OF THE DRAWINGS

The invention will be explained below with reference to examples of embodiments in connnection with the drawings, in which.

In the figures, identical positions are designated with the same reference numerals. The direction of flow of the media is indicated by arrows.

DETAILED DESCRIPTION

The invention will be explained in greater detail below with reference to an embodiment and to FIGS. 1 and 2.

Figure 1:
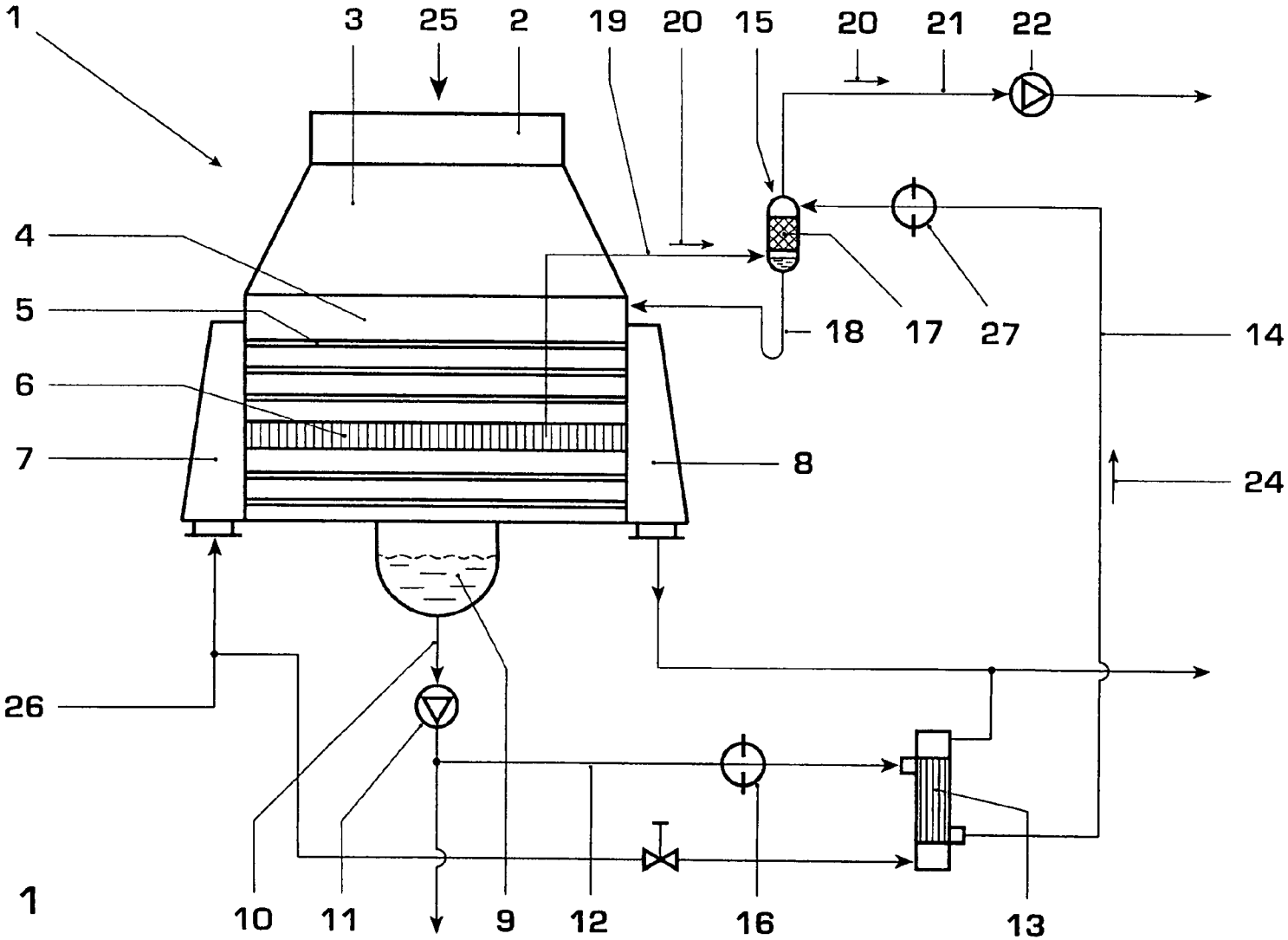
FIG. 1 shows a schematic depiction of the flowchart of the deaerating and degassing system according to the invention.
Figure 2:
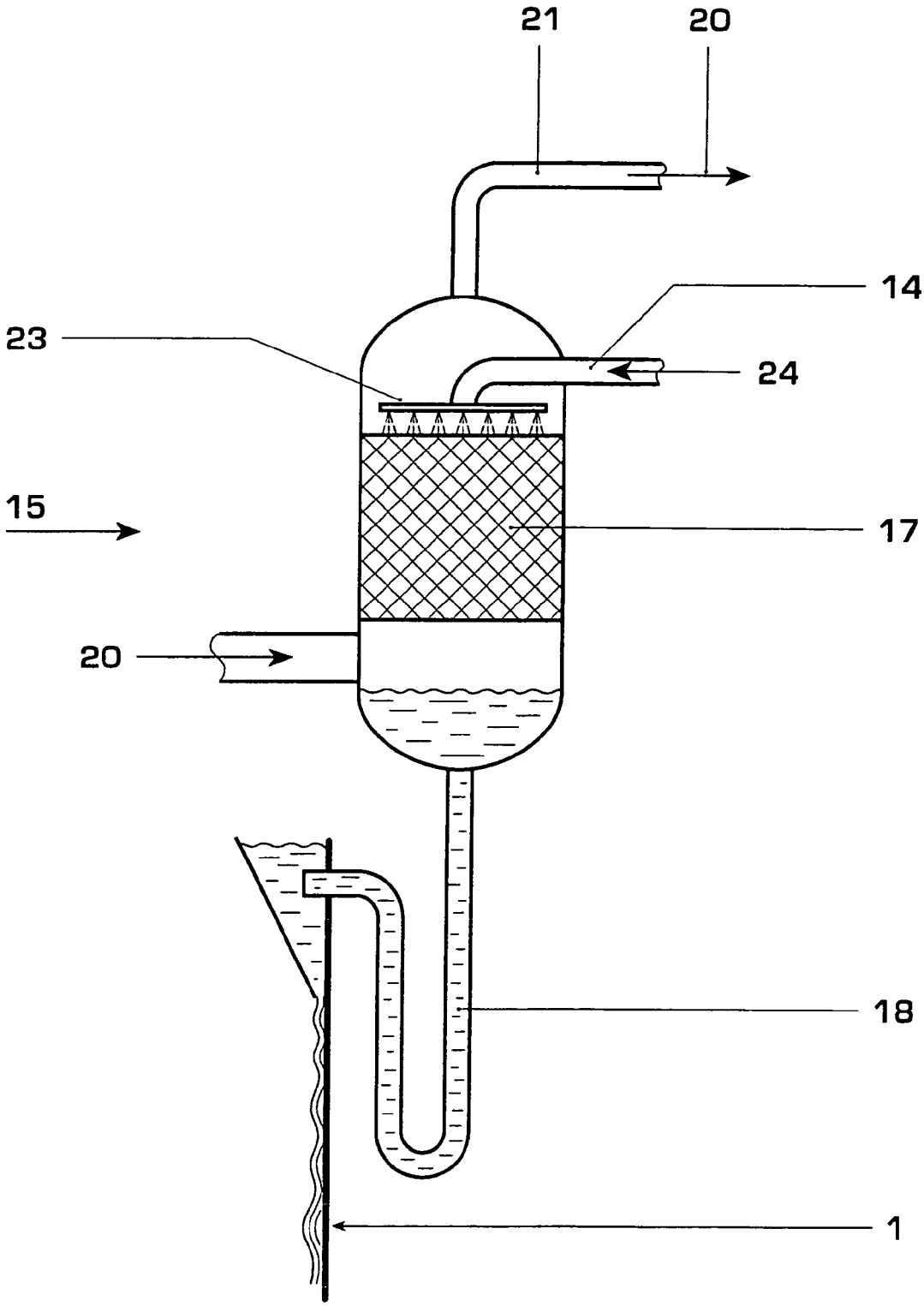
FIG. 2 shows an enlarged detail from FIG. 1 showing the device used for direct-contact condensation.

FIG. 1 shows a schematic depiction of the flowchart of the deaerating and degassing system according to the invention for a power plant condenser, while FIG. 2 depicts an enlarged detail from FIG. 1.

For a better understanding of the invention, it is advantageous to view both figures at the same time.

The condenser 1 has a condenser neck 2, a steam dome 3, condensate pipes 5 arranged in the condensation chamber 4 and an air cooler 6 as well as an inlet-water chamber 7, an outlet-water chamber 8 and a condensate collector 9 (hot well). Branching off from the condensate collector 9, there is a first condensate line 10 in which a condensate pump 11 is arranged.

Branching off from line 10 downstream from the condensate pump 11, there is a second condensate line 12 that leads to the inlet of a plate heat exchanger 13. In line 12, there is a throttle means 16 for regulating the condensate mass flow and for reducing the pressure from about 40-50 bar to 2-3 bar, which is very important for the plate heat exchanger 13.

The outlet of the plate heat exchanger 13 is connected to a third condensate line 14 leading to a device for direct-contact condensation 15 consisting of at least one packing column 17 and opening up into the part of the device 15 that is located above the packing column 17. A diaphragm 27 is installed in the line 14 and it serves to prevent the formation of a two-phase flow in the water-feed line. At the end of the condensate line 14, there is a liquid distribution device 23 for the cold condensate 24. In this embodiment, the device 15 is located outside of the condenser 1.

The generally known packing column 17 consist of inserts having a very large surface area. A siphon 18 branches off from the lower part of the device 15, which is located below the packing column 17. The siphon 18 opens up into the condenser 1 in such a way that the condensate mixture is degassed as a wall wet column.

A suction line 19 coming from the air cooler 6 for the steam-inert gas mixture 20 opens up into the lower part of the device 15.

A suction line 21 for the volume flow of the steam-inert gas mixture 20, which is reduced in the packing column 17, branches off from the upper part of the device 15. The suction line 21 opens up into the suction aggregate 22. This suction aggregate 22 is a vacuum pump, for example, a water-jet vacuum pump, a liquid-seal pump or a steam-jet ejector.

The system functions as follows:

Turbine exhaust steam 25 flows through the condenser neck 2 and through the steam dome 3 of the condenser 1 into the condensation chamber 4. Cooling water 26 is uniformly fed into the condensate pipes 5 via the inlet-water chamber 7, flows through the condensate pipes 5 and then leaves the condenser 1 via the outlet-water chamber 8. The turbine exhaust steam 25 condenses on the outside of the condensate pipes 5 and releases the condensation heat to the cooling water 26 inside the pipes 5. The condensate that is formed is then collected in the condensate collector 9 and subsequently returned to the steam circulation system via the line 10 by means of the condensate pumps 11.

Part of the condensate is branched off from the line 10 downstream from the condensate pump 11 and recirculated to the condenser 1 so that a minimum quantity is present during start-up or during partial-load operation. The quantity of condensate needed for this purpose is small. It is, for instance, about 3 kg to 5 kg for a ratio of 1 to 30-40 of the suction apparatus mixture mass flow to the cold condensate for a condenser of the 300 MWe class.

The condensate to be returned to the condenser 1 is fed to the plate heat exchanger 13 via the line 12. Since the plate heat exchanger 13 is also fed with cold cooling water 26, heat exchange takes place there. The condensate is cooled from the condensation temperature down to approximately 1 K relative to the cooling-water inlet temperature. Instead of a plate heat exchanger, it is also possible to employ a tubular heat exchanger. With these devices, however, 100% redundancy should be provided since cleaning is carried out on an alternating basis.

The cold condensate 24, which now has a temperature close to the inlet temperature of the cooling water 26, is subsequently conveyed via the line 14 to the device 15 consisting of at least one packing column 17 and distributed over the packing column 17 by means of a liquid distributor 23, for instance, spraying nozzles. The at least one packing column 17 is known to consist of filling material or structured packings having a very large surface area. For example, the volume-specific transfer surface area of the packings of a commercially available product is approximately 250 $m^2/m^3$. Piping having an outer diameter of 24 mm and a web of 8 mm results in approximately 85 $m^2/m^3$.

Chilled condensate 24 and the steam-inert gas mixture 20, which is introduced by the air cooler 6 into the lower part of the device 15 via the line 19, flow through the at least one packing column 17 in direct contact in a countercurrent. The heat exchange is considerably improved due to the direct contact and to the large surface area of the packing, which result in long retention times and vortexing. Consequently, part of the steam condenses in the steam-inert gas mixture 20. The reduction in the steam fraction reduces the total mass flow of the steam-inert gas mixture 20 that is fed to the suction aggregate 22 via the suction line 21.

In an example, it was ascertained that the volume flow can be reduced by 35% to 45%, as a result of which the pressure loss in the suction line 21 is cut back by more than half. The pressure loss via the packing at a loading factor of 1.72 at the bottom end of the packing is less than 1 mbar. The volume reduction can be further improved by increasing the ratio of liquid volume flow (cold condensate 24) to counter volume flow (steam-inert gas mixture 20).

By changing the cold water flow and/or its temperature, the composition of the mixture can be precisely controlled.

Naturally, the invention is not restricted to the embodiment described. For instance, the device 15 can also be installed inside the condenser 1 if sufficient space is available, or else, thanks to the device 15, one can completely dispense with the internal air cooler 6 in the condenser 1. Aside from packing columns 17, it is also advantageous to employ tray columns, stage columns or simply spraying devices as the devices 15. Moreover, a tubular heat exchanger can also be arranged in the system instead of the plate heat exchanger.

The use of the invention yields the following advantages:

Improvement of the suction capacity, especially in the case of retrofitted condensers, when the existing suction aggregates are no longer sufficient for the newly set pressure and for the current thermal output. The use of this concept constitutes a technically and economically more favorable alternative to replacing or retrofitting the suction aggregate.

Shifting of the "cut-off" condenser pressure to lower partial-load values.

Reduction of circulation water loss due to suctioning.

Augmentation and/or partial or complete replacement of the internal air cooler of the condenser.

Reduction of the pressure loss via the suction line by reducing the volume flow of the gas mixture.

Moving away from the cavitation limit of liquid-seal pumps and water-jet aspirators.

LIST OF REFERENCE NUMERALS

1 condenser
2 condenser neck
3 steam dome
4 condensation chamber
5 condensate pipes
6 air cooler
7 inlet-water chamber
8 outlet-water chamber
9 condensate collector
10 first condensate line
11 condensate pump
12 second condensate line
13 tubular or plate heat exchanger
14 third condensate line
15 device used for direct-contact condensation
16 throttle means
17 packing column
18 siphon
19 suction line
20 steam-inert gas mixture
21 suction line
22 suction aggregate
23 liquid distributor
24 cold condensate
25 turbine exhaust steam
26 cooling water
27 diaphragm

What is claimed is:

1. A deaerating and degassing system for a power plant condenser having a condensate collector, the deaerating and degassing system comprising:

a suction aggregate;

a suction line for a steam-inert gas mixture connecting the condenser to the suction aggregate;

a direct contact condensation device disposed in the suction liner;

a heat exchanger disposed between the condensate collector and the direct contact condensation device configured to cool a condensate from the condensate collector so as to form a chilled condensate, wherein the steam-inert gas mixture flows through the direct contact condensation device in a direct contact countercurrent to the chilled condensate from the condensate collector.

2. The deaerating and degassing system as recited in claim 1, wherein the condenser includes an air cooler.

3. The deaerating and degassing system as recited in claim 2, wherein the suction line is configured to transport the steam-inert gas mixture from the air cooler of the condenser to the suction aggregate.

4. The deaerating and degassing system as recited in claim 1, further comprising:

a first condensate line for a condensate having a built-in condensate pump branching off from the condensate collector;

a second condensate line branching off from the first condensate line downstream from the condensate pump and connected to the heat exchanger, the condensate being chilled to a temperature close to a cooling water inlet temperature in the heat exchanger; and a third condensate line for the chilled condensate leading from the heat exchanger to the direct contact condensation device.

5. The deaerating and degassing system as recited in claim 4, wherein the heat exchanger is one of a tubular heat exchanger and a plate heat exchanger.

6. The deacrating and degassing system as recited in claim 1, wherein the direct contact condensation device includes at least one packing column.

7. The deaerating and degassing system as recited in claim 1, wherein the direct contact condensation device includes at least one of a stage and a tray contact apparatus.

8. The deaerating and degassing system as recited in claim 1, wherein the direct contact condensation device includes a spraying device.

9. The deaerating and degassing system as recited in claim 1, wherein the direct contact condensation device is disposed outside of the condenser.

10. The deaerating and degassing system as recited in claim 1, wherein the direct contact condensation device is disposed inside the condenser.

11. The deaerating and degassing system as recited in claim 6, further comprising a liquid distributor disposed above the packing column.

12. The deaerating and degassing system as recited in claim 1, wherein the direct contact condensation device includes a siphon for a condensate mixture opening up into the condenser so as to vent the condensate mixture as a wall wet column, the condensate mixture including the returned chilled condensate and a second condensate newly formed in the direct contact condensation device.

13. The deaerating and degassing system as recited in claim 1, wherein the deaerating and degassing system is configured for retrofitted condensers.

14. The deaerating and degassing system as recited in claim 1, wherein the deaerating and degassing system augments an internal air cooler of the condenser.

15. The deaerating and degassing system as recited in claim 1, wherein the deaerating and degassing system at least partially replaces an internal air cooler of the condenser.

* * * * *